United States Patent [19]

Dahlke

[11] 4,206,397

[45] Jun. 3, 1980

[54] TWO WIRE CURRENT TRANSMITTER WITH IMPROVED VOLTAGE REGULATOR

[75] Inventor: Charles J. Dahlke, New Germany, Minn.

[73] Assignee: Rosemount Inc., Eden Prairie, Minn.

[21] Appl. No.: 886,096

[22] Filed: Mar. 13, 1978

[51] Int. Cl.[2] ..... G05F 1/56

[52] U.S. Cl. ..... 323/22 T; 330/261

[58] Field of Search ..... 323/22 T, 38, 39; 330/261, 296, 297; 363/49

[56] References Cited

U.S. PATENT DOCUMENTS

| | | | |
|---|---|---|---|
| 3,573,599 | 4/1971 | Rose | 361/1 |
| 3,626,278 | 12/1971 | Matsumura et al. | 323/22 T |
| 3,697,861 | 10/1972 | Frazier | 323/22 T |
| 3,764,880 | 10/1973 | Rose | 363/22 |
| 3,787,757 | 1/1974 | Sheng | 323/22 T |

FOREIGN PATENT DOCUMENTS

| | | | |
|---|---|---|---|
| 1491293 | 8/1967 | France | 323/22 T |

OTHER PUBLICATIONS

Leung, "Short Circuit Protection & Starting Device for Series Regulator", IBM Tech. Discl. Bull., vol. 7, No. 12, May 1965, pp. 1234–1235.

*Primary Examiner*—A. D. Pellinen

*Attorney, Agent, or Firm*—Kinney, Lange, Braddock, Westman and Fairbairn

[57] ABSTRACT

A two wire current transmitter for controlling total current in two wires in accordance with the value of a parameter to be sensed which provides for an improved voltage regulator which incorporates within the voltage regulator two separate paths for start-up current of the regulator, hence, providing improved start-up characteristics for both isolated and nonisolated two wire transmitters.

11 Claims, 1 Drawing Figure

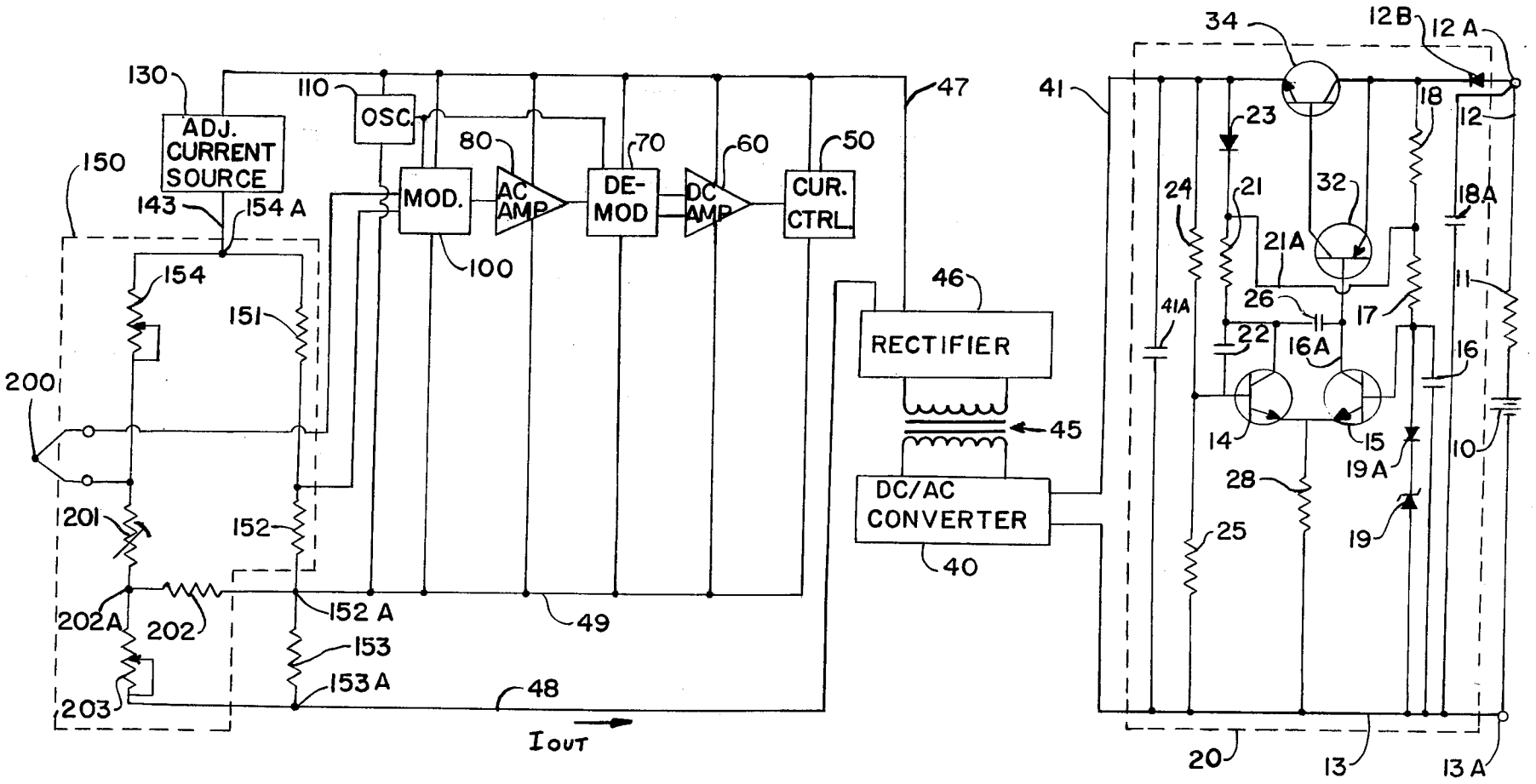
RECTIFIER
DC/AC CONVERTER
CUR. CTRL.
DC AMP
DE-MOD
AC AMP
MOD.
OSC.
ADJ. CURRENT SOURCE
$I_{OUT}$

TWO WIRE CURRENT TRANSMITTER WITH IMPROVED VOLTAGE REGULATOR

BACKGROUND OF THE INVENTION

1. Field of the Invention

The invention relates to a two wire current transmitter where current through a DC source and load is controlled by the transmitter to correspond with the magnitude of a value of a parameter to be sensed by a sensing element, which may typically be a thermocouple wherein DC isolation is provided, or a temperature sensitive resistor without isolation.

2. Prior Art

U.S. Pat. No. 3,573,599 issued Apr. 6, 1971, discloses a transformer coupling to provide DC isolation to a sensing circuit from a supply circuit in a two wire current transmitter. The sensing circuit includes AC amplifier, whose input repetitively samples and compares the signals of the DC sensor network from the DC feedback network which is transformer coupled to the supply circuit. A DC amplifier on the supply side acts as the current controller for the supply current. Multiple AC coupling means are required between a sensing element and a supply current.

A two wire transmitter is described in U.S. Pat. No. 3,764,880 issued Oct. 9, 1973, wherein a single transformer is provided for DC isolation between a transducer circuit and a source circuit. The source circuit is connected to an input side of a voltage regulator which provides a regulated voltage to a DC to DC converter over the current range of the transmitter which may be, for example, 4–20 milliamperes. The voltage regulator of this circuit requires only a small, substantially constant operating current to provide required operating voltage regulation to the converter circuit.

SUMMARY OF THE INVENTION

The present invention comprises a two wire electrical transmitter having a voltage regulator circuit which provides two sources of start-up current to the voltage regulator components upon energization of the transmitter circuitry. The additional current source overcomes a long standing problem associated with two wire transmitter circuits of slow circuit start-up or circuit initialization. The voltage regulator circuit may be used with an isolated sensing circuit as shown herein, or with nonisolated sensing circuits if desired.

BRIEF DESCRIPTION OF THE DRAWING

The single FIGURE of the drawing is a block diagram representation of a typical transmitter circuitry and a detailed electrical schematic representation of a voltage regulator circuitry incorporated into the two wire transmitter of the present invention.

DESCRIPTION OF THE PREFERRED EMBODIMENT

This invention comprises circuit element similar to those as described in my co-pending application Ser. No. 886,095, filed Mar. 13, 1978 entitled Two Wire Current Transmitter With Adjustable Current Control Linearization. Referring to the drawing, a DC power supply 10 and a series load resistor 11, both of which may be remotely located from the rest of the circuitry are series connected to a voltage regulator 20 outlined in dotted lines, by a line 12 through a terminal 12A and by a line 13 through a terminal 13A. Voltage regulator

20 provides a stable output DC voltage which is impressed on a DC to AC converter 40 through a voltage regulator output line 41 and line 13. DC to AC converter 40 is a semiconductor oscillator which converts stable output voltage of regulator 20 to an alternating voltage in a known manner. The AC voltage is impressed on a primary winding of a transformer 45 which is directly connected to the output of DC to AC converter 40. Transformer 45 provides for electrical isolation of transducer circuitry of a sensor portion on the output side from undesirable interference and transients. The functions and operation of the transformer are further explained in U.S. Pat. No. 3,764,880, for example. Changes in current flows in the transformer secondary result in a corresponding change in the current in the transformer primary winding.

Voltage regulator 20 has a diode 12B in line 12 for circuit polarity reversal protection. Diode 12B is connected at its anode to line 12. A resistor 18 is connected to the cathode of diode 12B and in turn resistor 18 connects in series to a resistor 17, which is connected at its opposite end through a diode 19A to the cathode of a Zener diode 19 which in turn has its anode connected to line 13. A transistor 15 is coupled to a transistor 14 to comprise a differential amplifier. The noninverting input of this amplifier comprises the base of transistor 15, which is connected between the resistor 17 and the anode of diode 19A. In operation the combination of diode 19A and diode 19 provide a stable reference voltage at the base of transistor 15. A capacitor 16 is connected across diodes 19 and 19A to suppress transients. The inverting input of the differential amplifier comprises the base of transistor 14. The base of the transistor 14 is connected to line 41 through a diode 23, a resistor 21 and a capacitor 22. One end of a line 21A is connected between the cathode of diode 23 and resistor 21 and at its second end between resistors 17 and 18. The base of transistor 14 is also connected between a resistor 24 and a resistor 25 which are in series and comprise the regulated voltage sense line connected across lines 41 and 13. A capacitor 18A is connected across input terminals 12A and 13A for RFI (radio frequency interference) suppression and a filter capacitor 41A is connected across line 41 and 13.

A transistor 32 and a transistor 34 comprise a complementary series regulator transistor pair. The collector of transistor 15 is connected to the base of transistor 32 through a line 16A. The emitter of transistor 32 is connected to the cathode of diode 12B and the collector of transistor 32 is connected to the base of transistor 34. The collector of transistor 34 is connected to the cathode of diode 12B and the emitter of transistor 34 is connected to line 41.

The collector of transistor 14 is connected to line 16A between the collector of transistor 15 and the base of transistor 32 through capacitor 26. The collector of transistor 14 is also connected between capacitor 22 and resistor 21. The emitter of transistor 14 is connected to the emitter of transistor 15. The emitters of transistors 14 and 15 are connected through a resistor 28 to line 13.

Voltage regulator 20 begins operation in the following manner. As DC power supply 10 starts increasing in voltage after being initially connected in the circuit, or switched on, diode 23 is reverse biased and diode 19, the reference voltage diode, is not conducting. Transistor 15 of the differential amplifier begins to forward bias and a further increasing of voltage from DC power supply 10 causes transistor 15 to begin conducting, which turns on transistor 32 through the collector of transistor 15 and connection to the base of transistor 32. Transistor 32 in turn then provides base current to transistor 34; hence, transistor 34 starts conducting. When the regulator output voltage on line 41 is greater than the voltage on line 21A, diode 23 starts to forward bias. This condition provides a second start-up current for the regulator circuit through diode 23, line 21A and resistor 17 to the base of transistor 15 which second startup current is thus summed with the first start-up current and causes more conduction of transistor 15. Further increase in voltage of DC power supply 10 on line 12 starts reference diode 19 conducting, establishing the desired reference level signal at the base of transistor 15 and consequently regulating the voltage across lines 41 and 13.

During operation the base of transistor 14 is biased by the output voltage of regulator 20 across lines 41 and 13. If the output voltage increases slightly, transistor 14 becomes more conductive which causes transistor 15 to decrease conduction. Reduced conduction in transistor 15 provides less current to the complementary pair of transistor 32 and transistor 34, thus decreasing output voltage. The operation of voltage regulator 20 is similar but opposite for a decreasing voltage. Regulator 20 uses a very constant small current which is substantially constant with changes in temperature. The sum of the first and second start-up currents also remain substantially constant during operation (after start-up when the output voltage is regulated) in that the voltage drops across the diode 23, the resistor 17, the diode 19A and the diode 19 are constant. This is important in an isolated two wire transmitter since the current in the regulator does not pass through the delta feedback resistor network which will be explained.

On the sensor side of transformer 45 the transformer secondary is connected to a rectifier 46, which converts AC voltage from transformer 45 to a stable DC voltage in a normal manner for powering the transducer circuitry shown in block diagram form. The transducer control circuitry is shown by way of example only and may take any desired form. As shown, rectifier 46 is connected to the subsequent circuitry by lines 47 and 48. An oscillator 110 receives power from line 47 and is connected to line 49 and is also connected to the control inputs of a modulator 100 and a demodulator 70. Oscillator 110 provides through the control inputs to modulator 100 and demodulator 70 a series of pulses such that a first and a second signal sensed at the first and second inputs to modulator 100, are alternately modulated and demodulated, respectively. An adjustable current source 130 is connected to line 47 and is connected by line 143 and terminal 154A to a sensor network 150. Sensor network 150 on one side has a zeroing variable resistor 154 which is connected to terminal 154A. Resistor 154 is also connected to a sensor 200 which may be a thermocouple as shown. Sensor 200 is connected at a second end to a first input of modulator 100. This input to modulator 100 carries a signal representative of the parameter to be sensed in this instance, temperature. Also connected to a second end of zeroing resistor 154 and a first end of sensor 200 is a resistor 201 which may provide cold junction compensation. The combination of an adjustable resistor 203, resistor 202, and a resistor 153 is a "delta entrant bridge" feedback network. The feedback network is connected at one junction 202A to a second end of resistor 201, at a second junction 152A to line 49 and at a third junction 153A to line 48.

The second side of sensor network 150 is connected from terminal 154A through a resistor 151 and through a resistor 152 to line 49 and to the second junction 152A of the feedback network between resistors 202 and 153. A reference signal is provided at a junction between resistors 151 and 152 to a second input to a modulator 100. Hence, at a first input of modulator 100 a signal representative of the measured, variable parameter is sensed, and at the second input, the reference signal is sensed. On alternate cycles of oscillator 110, modulator 100 outputs the variable signal and the reference signal, respectively, to an AC amplifier 80 which amplifies the signal received. AC amplifier 80 outputs the amplified signal to demodulator 70, which on alternate cycles of oscillator 110 outputs the amplified varying parameter based signal to one input terminal of a differential operational amplifier 60 and the amplified reference signal to the other input terminal of amplifier 60. Amplifier 60 provides an output representative of the differential signal presented at its input terminals and outputs a signal to a current control circuit 50 which will either increase or decrease the current through the current control 50 to again balance sensor network 150 and equalize the signals at the input of the modulator 100. The current through current control 50 rebalances sensor network 150 by sending its current through line 49 and through the delta re-entrant feedback resistors 203, 202, and 153 thus producing a skewing voltage to rebalance sensor network 150. Modulator 100, AC amplifier 80, DC modulator 70, DC amplifier 60, and current control 50 are all connected to and powered from lines 47 and 49 which are connected to the output of rectifier 46. Virtually all the current from those components flows through the delta reentrant feedback network and through line 48, which is represented by $I_{out}$. Since current control 50 is adjusted based on the differential or unbalance in sensor network 150, $I_{out}$ is representative of the condition to be sensed. $I_{out}$ flows through line 48 through rectifier 46 where it affects the AC current through transformer 45 and is thus reflected into DC to AC converter 40. The current flow through lines 41 and 13 changes to achieve a balance of currents in transformer 45. The changed current flows through DC power supply 10, load resistor 11, terminal 12A, line 12, regulator 20, and line 41, then back through DC to AC converter 40, transformer 45, rectifier 46, line 47 through the current control 50, and through the delta reentrant feedback resistors 202, 203 and 153 to line 48 thus completing the circuit. Since the current required internally by the voltage regulator 20 and DC to AC converter 40 is not passed through the feedback resistance network of the transducer, current required to operate these devices must be substantially constant with temperature and changes in $I_{out}$. Since the current from these devices does not pass through the feedback resistance network, but are substantially constant, the DC component of these currents and the current at "zero" from line 48 represented in the current of line 13 are constant value offset currents. This "zero" offset may be corrected if desirable by additional circuitry external from load resistor 11.

It should be noted the second start up current thru diode 23 is enhanced by the gains of transistors 15, 32 and 34 respectively.

What is claimed is:

1. A two wire current transmitter voltage regulator with an input and an output having a DC power supply coupled to the input and including:

an amplifier means having an amplifier input and an amplifier output which delivers an amplified signal;

first means coupled to said amplifier input for providing a first regulator start-up current upon activation of the DC power supply to thereby initiate operation of the amplifier means;

second means coupled to the amplifier output and to the amplifier input for providing a second regulator start-up current derived from the amplifier output to the amplifier input.

2. The apparatus of claim 1 further including a reference signal means coupled across said voltage regulator input and to the amplifier input for establishing a reference signal level at the amplifier input.

3. An apparatus according to claim 1 wherein the first and second means are both connected to the amplifier input to provide first and second regulator start-up currents to the amplifier means at substantially all times after the second means is operative to provide the second regulator current and is providing a regulated output.

4. The apparatus of claim 1 wherein said amplifier means includes a second amplifier input forming part of the second means, means coupled to the output of said voltage regulator and to the second amplifier input to control the amplifier output as a function of the voltage at the voltage regulator output.

5. The apparatus of claim 1 wherein said second means includes a diode connected to conduct from the amplifier output to the amplifier input.

6. An apparatus according to claim 1 wherein said first and second means are connected to provide first and second currents which are summed at the amplifier input and said regulator further including means to maintain the sum of the first and second currents substantially constant during operation of the regulator after start-up.

7. A two wire transducer circuit including a voltage regulator having an input and an output, said input comprising a pair of terminals for connecting said voltage regulator to a remote series connected power supply and load, said voltage regulator including amplifier means, voltage control means coupled across the pair of terminals and providing a controlled voltage signal, said amplifier means including a control input coupled to sense the controlled voltage signal and having an amplifier output connected to the output of the voltage regulator, means coupled to said voltage control means to provide a first current signal from one of said terminals when a voltage is applied to the one terminal from a power supply, and means coupled to the amplifier output providing a second separate current signal to said control input which second separate current signal is summed with the first current signal and which thereby tends to increase the signal at the amplifier output when a voltage is first applied to said one terminal.

8. The transducer circuit of claim 7 wherein said voltage control means comprises a voltage control diode having a cathode and an anode and being coupled across said pair of terminals.

9. The combination as specified in claim 7 wherein said amplifier means includes an inverting input sensitive to the voltage at the output of said voltage regulator and operative to decrease the output of said amplifier means when the voltage regulator output tends to increase from a desired level.

10. The two wire transducer circuit as specified in claim 8 wherein said means coupled to the amplifier output providing a separate second current signal includes a second diode connected to conduct from the amplifier output to the control input.

11. The two wire transducer of claim 10 wherein said amplifier means comprises a transistor connected to conduct as a function of the signal at said control input, and said means coupled to the voltage control diode to provide a first current signal includes a resistor coupled to said one terminal at one end thereof and to the cathode of said voltage control diode and the control input at its other end, said second diode being connected to conduct to said other end of said resistor.

* * * * *